US011056297B2

(12) United States Patent
Dahl et al.

(10) Patent No.: US 11,056,297 B2
(45) Date of Patent: Jul. 6, 2021

(54) TRIGGER ELEMENT OF A PRESSURE TRIGGER, PRESSURE TRIGGER WITH A TRIGGER ELEMENT OF THIS KIND AND ELECTRIC SWITCH

(71) Applicant: Siemens Aktiengesellschaft, Munich (DE)

(72) Inventors: Joerg-Uwe Dahl, Werder (DE); Erhard Deylitz, Berlin (DE); Oliver Andersen, Berlin (DE); Pawel Biedunkiewicz, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 16/634,957

(22) PCT Filed: Jul. 30, 2018

(86) PCT No.: PCT/EP2018/070584

§ 371 (c)(1),
(2) Date: Jan. 29, 2020

(87) PCT Pub. No.: WO2019/025361

PCT Pub. Date: Feb. 7, 2019

(65) Prior Publication Data

US 2020/0219686 A1 Jul. 9, 2020

(30) Foreign Application Priority Data

Aug. 1, 2017 (DE) ..... 102017213238.8
Jul. 18, 2018 (EP) ..... 18184233

(51) Int. Cl.
*H01H 9/34* (2006.01)
*H01H 33/02* (2006.01)
(Continued)

(52) U.S. Cl.
CPC ..... *H01H 33/42* (2013.01); *H01H 9/342* (2013.01); *H01H 33/53* (2013.01); *H01H 33/82* (2013.01);
(Continued)

(58) Field of Classification Search
CPC ..... H01H 33/42; H01H 33/53; H01H 33/83; H01H 33/022; H01H 9/043; H01H 9/30;
(Continued)

(56) References Cited

U.S. PATENT DOCUMENTS 3,631,369 A * 12/1971 Menocal ..... B60S 3/04 337/110
5,103,198 A 4/1992 Morel et al.
(Continued)

FOREIGN PATENT DOCUMENTS

DE 69110540 T2 2/1996
DE 69217441 T2 7/1997
(Continued)

OTHER PUBLICATIONS

PCT International Search Report and Written Opinion of International Searching Authority dated Oct. 18, 2018 corresponding to PCT International Application No. PCT/EP2018/070584 filed Jul. 30, 2018.
(Continued)

*Primary Examiner* — William A Bolton
(74) *Attorney, Agent, or Firm* — Harness, Dickey & Pierce, P.L.C.

(57) ABSTRACT

A device for recognizing an arcing fault in incident light that includes a sensor for detecting absorption lines of the incident light, and an evaluation unit which generates an evaluation signal when characteristic absorption lines are detected.

17 Claims, 6 Drawing Sheets

(51) Int. Cl.

| | |
|---|---|
| ***H01H 33/42*** | (2006.01) |
| ***H01H 33/82*** | (2006.01) |
| ***H01H 33/53*** | (2006.01) |
| ***H01H 33/83*** | (2006.01) |
| ***H01H 71/24*** | (2006.01) |
| ***H01H 77/02*** | (2006.01) |

(52) U.S. Cl.
CPC ..... *H01H 33/83* (2013.01); *H01H 33/022* (2013.01); *H01H 2009/343* (2013.01); *H01H 2071/2427* (2013.01); *H01H 2077/025* (2013.01)

(58) Field of Classification Search
CPC .... H01H 9/563; H01H 9/342; H01H 71/0271; H01H 71/025; H01H 73/18; H01H 2009/343; H01H 2077/025
USPC ..... 218/153–156, 48, 51, 52, 86, 88, 109, 218/114; 335/172; 200/81.9 R
See application file for complete search history.

(56) References Cited

U.S. PATENT DOCUMENTS

| | | | | |
|---|---|---|---|---|
| 5,298,874 | A | 3/1994 | Morel et al. | |
| 5,731,561 | A * | 3/1998 | Manthe | H01H 9/34 218/157 |
| 6,556,111 | B2 * | 4/2003 | Felden | H01H 71/446 335/172 |
| 6,995,640 | B2 * | 2/2006 | Harmon | H01H 77/02 218/154 |
| 7,403,087 | B2 * | 7/2008 | Oh | H01H 77/10 335/172 |
| 8,063,334 | B2 | 11/2011 | Dahl | |
| 8,471,657 | B1 * | 6/2013 | Shea | H01H 71/12 335/201 |
| 8,553,385 | B2 | 10/2013 | Ahlert | |
| 8,698,024 | B2 * | 4/2014 | Woodson | H01H 71/0271 200/332 |
| 8,947,182 | B2 | 2/2015 | Ahlert et al. | |
| 9,508,511 | B2 * | 11/2016 | Legendre | H01H 9/342 |
| 2001/0045879 | A1 * | 11/2001 | Reichard | H01H 77/02 335/172 |
| 2002/0130744 | A1 * | 9/2002 | Jodehl | H01H 77/10 335/172 |
| 2013/0126316 | A1 | 5/2013 | Woodson | |
| 2019/0043679 | A1 | 2/2019 | Andersen et al. | |

FOREIGN PATENT DOCUMENTS

| | | | |
|---|---|---|---|
| DE | 102008039152 | A1 | 2/2010 |
| DE | 102009015126 | A1 | 10/2010 |
| DE | 102011077359 | A1 | 12/2012 |
| EP | 2081202 | A2 | 7/2009 |

OTHER PUBLICATIONS

Extended European Search Report dated Nov. 28, 2018.

* cited by examiner

TRIGGER ELEMENT OF A PRESSURE TRIGGER, PRESSURE TRIGGER WITH A TRIGGER ELEMENT OF THIS KIND AND ELECTRIC SWITCH

PRIORITY STATEMENT

This application is the national phase under 35 U.S.C. § 371 of PCT International Application No. PCT/EP2018/070584 which has an International filing date of Jul. 30, 2018, which designated the United States of America and which claims priority to European patent application EP 18184233.7 filed Jul. 18, 2018 and to German patent application no. DE 102017213238.8 filed Aug. 1, 2017, the entire contents of each of which are hereby incorporated herein by reference.

FIELD

Embodiments of the invention generally relate to a trigger element of a pressure trigger for an electric switch, a pressure trigger with a trigger element, and an electric switch with such a pressure trigger.

BACKGROUND

Typically, current-limiting switchgears, in particular current-limiting circuit breakers, for example in the form of MCCBs (Molded Case Circuit Breakers), are used in extensively branched power distribution networks. It is customary to conduct selective staggering with a minimum nominal current distance between the switchgears involved. Each branching plane can be protected here against overloads and short circuits that occur by a switchgear which is appropriately dimensioned depending on the connected consumers.

For example, a switchgear which is arranged closest to a consumer and which is often referred to as a consumer-close or downstream switchgear is configured for the lowest nominal current. If a short circuit current then flows both through the consumer-close switchgear and through a switchgear which is arranged above the consumer-close switchgear in the hierarchy of the power distribution network and is often referred to as a consumer-remote or upstream switchgear, only the consumer-close switchgear is intended to switch off. In other words, in the event of a malfunction (short circuit), only the switchgear which is closest to the event is intended to break the current flow.

Upon opening, the switch contact pairs of the consumer-close and of the consumer-remote switchgear draw an electric arc, wherein the opening width of the switch contact pairs and also the electric arc energy are higher in the case of the consumer-close switchgear because of the lower mass moment of inertia of its movable current path including the switch contacts. This opening, which, under some circumstances, is only a single-pole opening, has to be followed by an all-pole switching off of the consumer-close switchgear. The consumer-remote switchgear must not switch off so as not to disconnect further consumers from the power distribution network. However, the consumer-remote switchgear must act in an assisting manner by brief raising of the switch contacts, i.e. must contribute, for example, to the switching off of the consumer-close switchgear by limiting the current.

Switchgears which act in such a staggered manner in power distribution networks behave selectively. In order to achieve this selectivity, the switchgears lying closest to the malfunction have to break the current paths of all of the switching poles more rapidly than the switchgears arranged thereabove.

DE 691 10 540 T2 and DE 692 17 441 T2 each disclose electrical switching arrangements in the form of circuit breakers with insulating material housings, which, per switching pole, comprise two switch contacts which are pressed resiliently against each other in the switching-on position of the circuit breaker. The switch contacts can be disconnected by the action of electrodynamic recoil forces if the current flowing through the switch contacts exceeds a certain threshold value, in order thereby to bring about a limiting of the current mentioned.

The circuit breaker disclosed in the documents comprises an overload and/or short circuit detection element for acting upon a switching off mechanism which brings about the automatic switching off of the circuit breaker in the event of a fault. Furthermore, the circuit breaker disclosed in the documents comprises an actuating element which responds to a positive pressure generated in the separation zone of the switch contacts by way of an electric arc drawn in the event of an electrodynamic recoil of the switch contacts, in order to actuate the switching off mechanism of the circuit breaker.

The actuating member disclosed in the documents is a gas-tight unit which is connected exclusively to the separation zone of the switch contacts and comprises a movable element, for example a piston or a membrane, with a limited control stroke. The movable element is acted upon firstly with the positive pressure and secondly by a restoring device with adapted active force. The displacement of the movable element brings about the triggering of the switching off mechanism of the circuit breaker, wherein the restoring device with adapted active force is dimensioned such that an undesirable triggering in the event of a simple overload or a response of a downstream, current-limiting circuit breaker is prevented.

Further pressure triggers are likewise disclosed in the documents DE 10 2009 015 126 A1 and DE 10 2011 077 359 A1.

DE 10 2017 213 238 discloses a pressure trigger with nonreturn valves, in which a flow is permitted only from the separation zone of an electric switch in the direction of the actuating member of the pressure trigger.

SUMMARY

The inventors have discovered that extremely high temperature of the electric arc in the switch chamber (separation zone) causes a high pressure which is used by a pressure trigger in order to trigger the electric switchgear. The inventors have discovered that in the event of high switching capacities, particularly high temperatures and correspondingly high pressures arise which may damage the pressure trigger from the inside. Examples of damage include burn holes, ruptures or fusing which may make the pressure trigger non-functional.

At least one embodiment of the invention is directed to specifying an alternative trigger element for a pressure trigger.

At least one embodiment is directed to the trigger element. Advantageous refinements of the trigger element according to the invention are specified in the claims. At least one embodiment according to the invention is further directed to an electric switch. An advantageous refinement is specified in the claims.

The trigger element of at least one embodiment comprises an actuating member for a pressure trigger, wherein the pressure trigger is provided with at least one flow channel per electric pole, wherein the at least one pole of the electric switch comprises at least two switch contacts for making or breaking a current path, wherein the switch contacts of the at least one pole of the electric switch can be disconnected via the actuating member, which can respond to a pressure (p) that is generated by an electric arc (LB) drawn during electrodynamic recoil of the switch contacts in a separation zone of the in each case two switch contacts, and wherein the separation zone can be connected to the actuating member via the flow channel such that the actuating member is guided by a housing of the trigger element between a neutral position and a trigger position, wherein, after the trigger position has been reached, a relief of pressure vents the pressure trigger.

At least one embodiment is directed to a pressure trigger comprising a trigger element according to at least one embodiment of the invention.

At least one embodiment of the invention is directed to an electric switch comprising a plurality of poles and a pressure trigger according at least one embodiment of the invention, the plurality of poles of the electric switch each comprise at least two switch contacts for making or breaking a current path, wherein the switch contacts of the plurality of poles of the electric switch are disconnected via the actuating member, which responds to a pressure (p) which is generated by an electric arc (LB) drawn during electrodynamic recoil of the switch contacts in a separation zone of the in each case two switch contacts, and wherein the separation zones are connected to the actuating member via the flow channels.

BRIEF DESCRIPTION OF THE DRAWINGS

The above-described properties, features and advantages of this invention, and the manner in which they are achieved, will become clearer and more clearly comprehensible in conjunction with the description below of the example embodiments which will be explained in more detail in conjunction with the figures.

In the figures.

DETAILED DESCRIPTION OF THE EXAMPLE EMBODIMENTS

Figure 1:
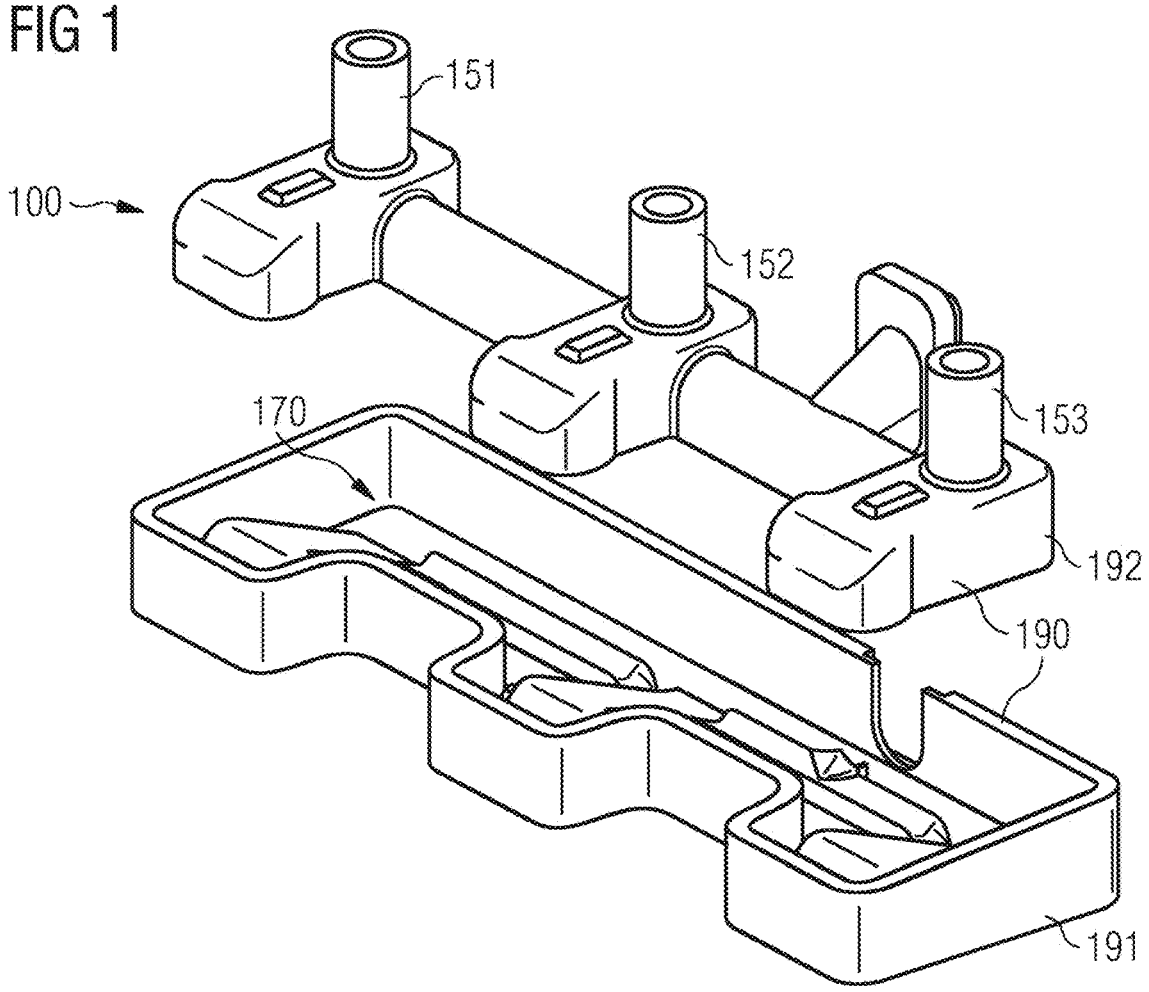
FIG. 1 shows a pressure trigger with a first housing part and a second housing part.

The trigger element of at least one embodiment comprises an actuating member for a pressure trigger, wherein the pressure trigger is provided with at least one flow channel per electric pole, wherein the at least one pole of the electric switch comprises at least two switch contacts for making or breaking a current path, wherein the switch contacts of the at least one pole of the electric switch can be disconnected via the actuating member, which can respond to a pressure (p) that is generated by an electric arc (LB) drawn during electrodynamic recoil of the switch contacts in a separation zone of the in each case two switch contacts, and wherein the separation zone can be connected to the actuating member via the flow channel such that the actuating member is guided by a housing of the trigger element between a neutral position and a trigger position, wherein, after the trigger position has been reached, a relief of pressure vents the pressure trigger.

It is advantageous in at least one embodiment that, up to the triggering time, there is a leakproof system of the pressure trigger and therefore short trigger times can be realized. Up to the triggering time, the pressure in the pressure trigger remains relatively constant, and therefore a high triggering force can be realized. The hot gases and the high pressure can escape via the relief of pressure, and therefore damage cannot occur due to the excess pressure situation. The trigger element according to at least one embodiment of the invention requires a purely structural change in the design of a known pressure trigger, and therefore no additional costs are incurred. During the controlled venting, the system is vented only if the excess pressure is no longer required for the triggering.

In one refinement of the trigger element, in the trigger position, the switch contacts of the at least one pole of the electric switch are separated.

In a further refinement of the trigger element, the actuating member is movable in a guide of the housing between a neutral position and a trigger position.

In one refinement of the trigger element, a recess in the guide of the housing brings about a relief of pressure of the pressure trigger in the trigger position.

In an alternative refinement of the trigger element, a bore, a slot or another type of opening in the housing brings about a relief of pressure of the pressure trigger in the trigger position.

At least one embodiment is directed to a pressure trigger comprising a trigger element according to at least one embodiment of the invention.

The pressure trigger according to at least one embodiment of the invention is optimized for rapid triggering. In terms of its design, it can be constructed compactly such that the paths for the compressed air are kept short, which can ensure more rapid triggering. The pressure trigger according to at least one embodiment of the invention can be designed as an assembly with integrated nonreturn valves at the interface with the pole cassettes.

In one refinement of the pressure trigger, the latter comprises at least one nonreturn valve which permits a flow only from the separation zone in the direction of the actuating member.

In a further refinement of the pressure trigger, the latter is constructed modularly from at least two valve elements having a respective nonreturn valve and a respective flow channel and also the trigger element with the actuating member, wherein the at least two valve elements and the trigger element are designed to be able to be plugged together.

In one refinement of the pressure trigger, the latter comprises closing elements and connecting elements which connect the at least two valve elements or the trigger element to one another or close same.

At least one embodiment of the invention is directed to an electric switch comprising a plurality of poles and a pressure trigger according at least one embodiment of the invention, the plurality of poles of the electric switch each comprise at least two switch contacts for making or breaking a current path, wherein the switch contacts of the plurality of poles of the electric switch are disconnected via the actuating member, which responds to a pressure (p) which is generated by an electric arc (LB) drawn during electrodynamic recoil of the switch contacts in a separation zone of the in each case two switch contacts, and wherein the separation zones are connected to the actuating member via the flow channels.

In one refinement of the electric switch, the latter comprises two or three electric poles, and the pressure trigger comprises three or four flow channels.

FIG. 1 illustrates a pressure trigger 100 for an electric switch 1000. The pressure trigger 100 comprises a housing 190 consisting of a first housing part 191 and a second housing part 192. Flow channels 151; 152; 153 which interact with, and are connectable to, separation zones 1201; 1202; 1203 of the electric poles 1101; 1102; 1103 of the electric switch 1000 are attached to the second housing part 192.

Figure 4:
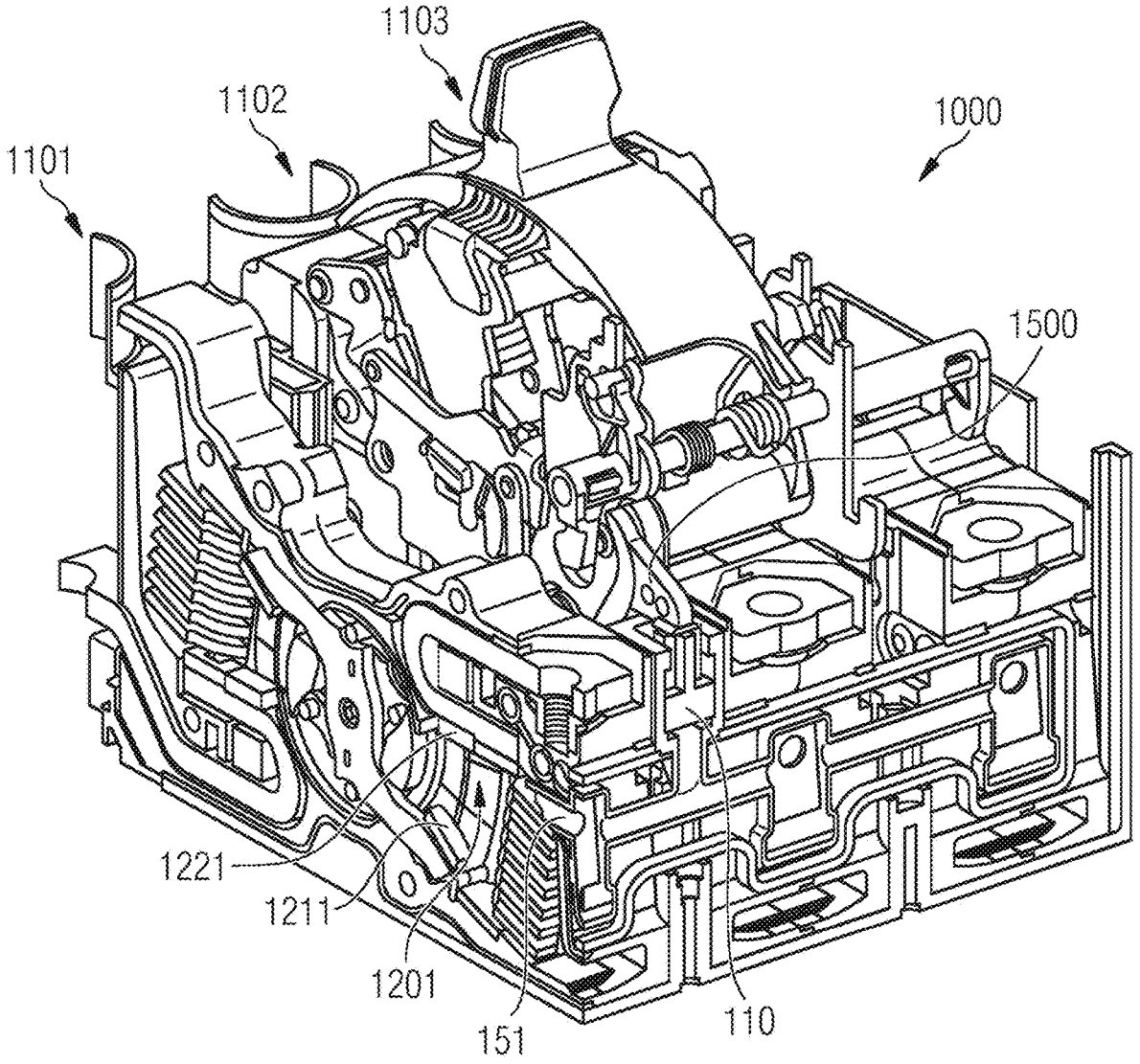
FIG. 4 shows an electric switch with a plurality of poles and pressure trigger.

A multi-pole electric switch 1000 is illustrated in FIG. 4. It comprises a plurality of poles 1101; 1102; 1103 having in each case at least two switch contacts 1211, 1221; 1212, 1222; 1213, 1223 for making or breaking a current path. Electric switches 1000 with two switch contacts are called single breaking electric switches and, in the case of more than two switch contacts, multiply breaking switches are referred to. The pressure trigger 100 is suitable for single breaking and for multiply breaking electric switches 1000.

According to FIG. 4, the multi-pole electric switch 1000 can comprise, for example, three electric poles 1101; 1102; 1103. The switch contacts 1211, 1221; 1212, 1222; 1213, 1223 of the plurality of poles 1101; 1102; 1103 of the electric switch 1000 can be disconnected via an actuating member 110 of the pressure trigger 100 by actuation of the trigger lever 1500, wherein the actuating member 110 can respond to a pressure (p) which is generated in a separation zone 1201, 1202, 1203 of the respective two switch contacts 1211, 1221; 1212, 1222; 1213, 1223 by an electric arc (LB) drawn during electrodynamic recoil of the switch contacts 1211, 1221; 1212, 1222; 1213, 1223. The separation zones 1201; 1202; 1203 are connected to the actuating member 110 via the flow channels 151; 152; 153. This means that the pressure (p) which arises in the separation zones 1201; 1202; 1203 because of the drawn electric arc (LB) is conducted in terms of flow inside the pressure trigger 100 to the actuating member 110.

Figure 2:
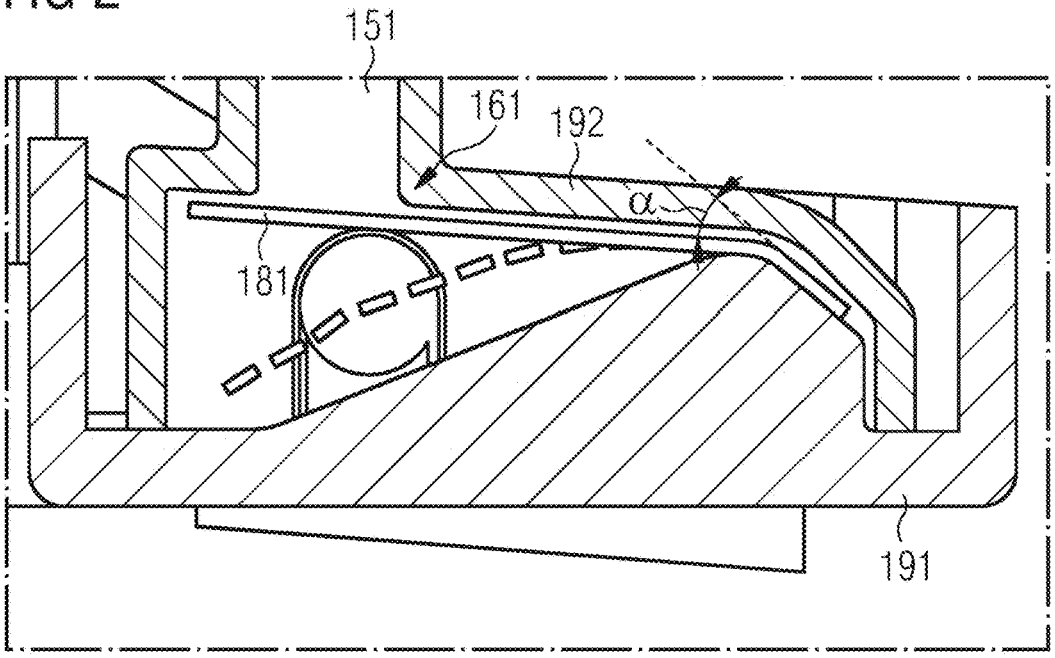
FIG. 2 shows a nonreturn valve with a tongue.

The pressure trigger 100 furthermore comprises nonreturn valves 161; 162; 163, as illustrated, for example, in FIG. 2. The nonreturn valves 161; 162; 163 are arranged at the respective flow channels 151; 152; 153 and permit only a flow from the respective separation zones 1201; 1202; 1203 in the direction of the actuating member 110. The nonreturn valves 161; 162; 163 especially serve to prevent a flow being possible from one separation zone 1201; 1202; 1203 to another separation zone 1201; 1202; 1203 of the poles 1101; 1102; 1103 of the electric switch 100.

According to FIG. 2, the nonreturn valve 161 comprises a tongue 181 which, in the inoperative state, covers the flow channel 151, as is illustrated in FIG. 2. In the event of a pressure (p) in the separation zone 1201 assigned to the flow channel 151, the tongue 181 opens up the flow channel 151 and a flow downward in accordance with FIG. 2 is made possible. Tongue 181 is then located in the position illustrated by dashed lines.

In the event of a pressure surge from an adjacent flow channel 152; 153 and therefore an increase in the pressure below the tongue 181 in accordance with the illustration of FIG. 2, the tongue closes the flow channel 151. This prevents a flow being possible from one separation zone 1201; 1202; 1203 to another separation zone 1201; 1202; 1203 of the poles 1101; 1102; 1103 of the electric switch 1000.

FIG. 1 furthermore shows that the pressure trigger 100 comprises a common collecting chamber 170 which is arranged between the respective nonreturn valves 161; 162; 163 and the actuating member 110.

Figure 3:
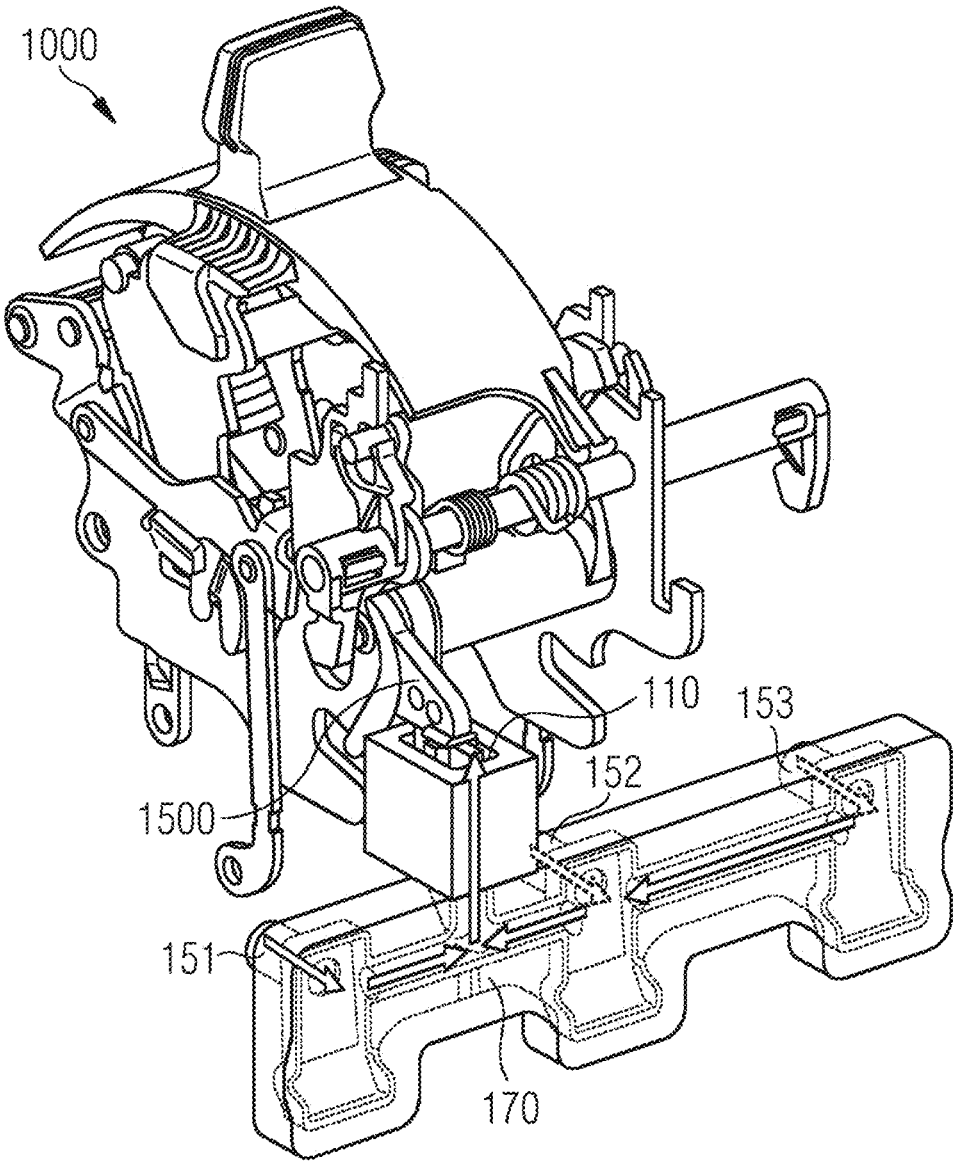
FIG. 3 shows an electric switch with a pressure trigger.

This is illustrated in more detail in FIG. 3 in which a flow through the flow channel 151 and through the nonreturn valve 161 located at the end thereof into the common collecting chamber 170 is illustrated. Owing to the increase in pressure in the common collecting chamber 170, the actuating member 110 is deflected upward in accordance with the illustration in FIG. 3 and actuates the trigger lever 1500 of the breaker mechanism of the multi-pole electric switch 1000.

The actuating member 110 can be designed as a tappet for actuating the trigger lever 1500 of the breaker mechanism. Furthermore, the actuating member 110 can be provided with a spring and can be held in an inoperative position by the spring. In the event of a pressure (p), the actuating member 110 can be actuated counter to the spring force of the spring. As a result, for example, the response behavior of the pressure trigger 100 can be set by selection of the spring.

The tongue 181 illustrated in FIG. 2 can be manufactured, for example, from aramid. Aramid is a particularly temperature-resistant material which is nevertheless flexible and pliant and permits a deflection of the tongue 181 from the inoperative position illustrated in FIG. 2 into the deflected position illustrated by dashed lines. The response behavior of the nonreturn valve 161 can be set by the material thickness of the tongue 181. Similarly, the response behavior can be set by the selection of the material of the tongue 181, on account of the rigidity of the material.

Furthermore, the tongue 181 can be held between the first housing part 191 and the second housing part 192 of the pressure trigger 100. The holding zone of the tongue 181 can have an angle (a) and/or a bending radius which is formed in the first housing part 191 or second housing part 192 and therefore constitutes a prestressing of the tongue 181 for closing the flow channel 151. The response behavior of the nonreturn valve 161 can likewise be set with the variation of the angle (a) of the holding zone of the tongue 181.

The closing elements 145; 145', the connecting elements 146, the valve elements 141; 142; 143 and the trigger element 147 can be connected by way of laser beam welding, ultrasonic welding, adhesive bonding or other joining methods, in order to ensure as great a gas tightness as possible.

Figure 5:
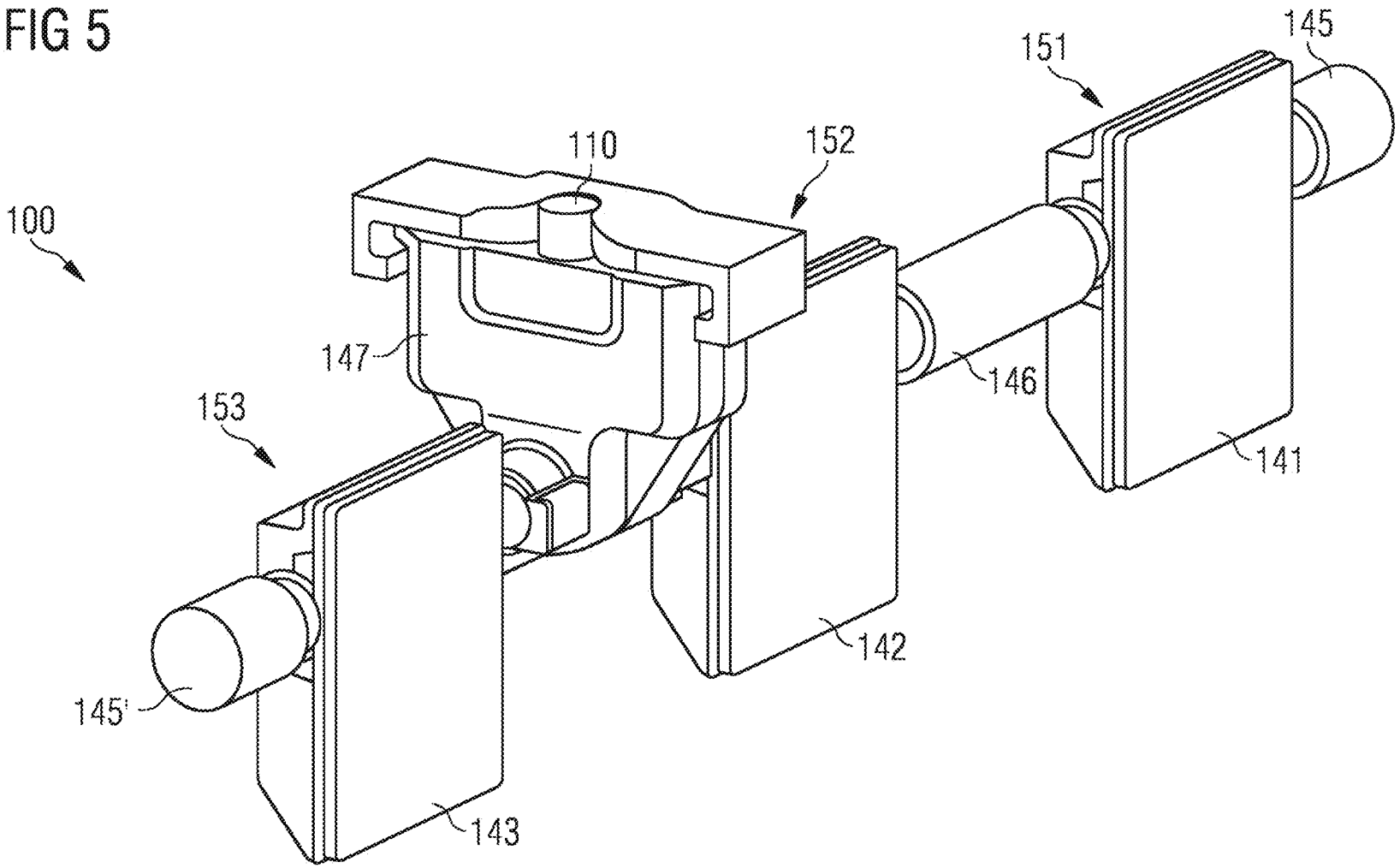
FIG. 5 shows a modular pressure trigger.

FIG. 5 illustrates a modularly constructed pressure trigger 100. The latter comprises valve elements 141; 142; 143 having a respective nonreturn valve 161; 162; 163 and a respective flow channel 151; 152; 153 (not included in the illustration of FIG. 5). Furthermore, the pressure trigger 100 illustrated in FIG. 5 comprises a trigger element 147 for separating the switch contacts 1211, 1221; 1212, 1222; 1213, 1223. For this purpose, the trigger element 147 is equipped with an actuating member 110, for example a tappet. The valve elements 141; 142; 143 and the trigger element 147 are designed so as to be able to be plugged together.

Furthermore, closing elements 145; 145' and connecting elements 146 are provided for the mechanical construction of the modular pressure trigger 100. The closing elements 145; 145' and the connecting elements 146 serve for the construction of a pressure trigger 100 which can be plugged together together with the valve elements 141; 142; 143 and the trigger element 147.

An advantage of the modular pressure trigger 100 is that the latter is usable on electric switches 1000 having a different number of poles 1101; 1102; 1103 and is adaptable thereto. Higher piece numbers of the individual elements, such as the valve elements 141; 142; 143, permit cost-effective manufacturing. A mechanical compensation for tolerances between the phases can likewise be undertaken via the modular pressure trigger 100.

FIGS. 6A, 6B, 6C and 6D illustrate the manner of operation of the trigger element 147 according to an embodiment of the invention.

Figure 6A:
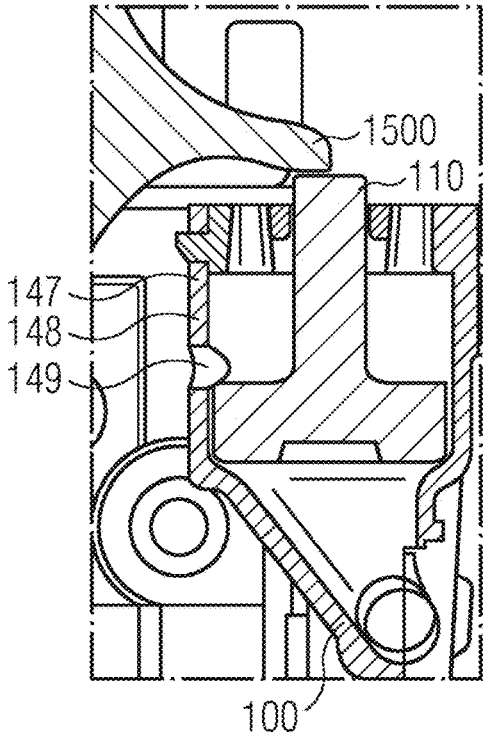
FIGS. 6A, 6B, 6C, 6D show a trigger element with relief of pressure.

In the illustration of FIG. 6A, the electric switch 1000 is switched on, the switch contacts 1211, 1221; 1212, 1222; 1213, 1223 are closed and the actuating member 110 is in the neutral position. The housing 148 of the trigger element 147 has a bore 149 which is concealed and closed by the actuating member 110. The vent is thereby closed and a buildup of pressure in the pressure trigger 100 is made possible.

Figure 6B:
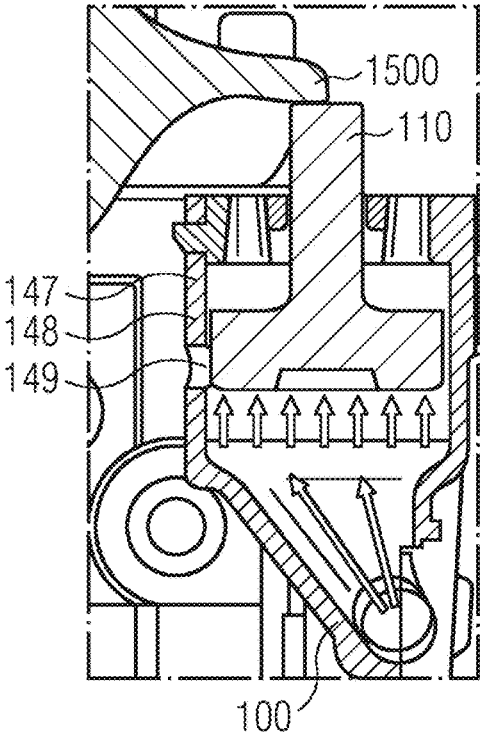

In the illustration of FIG. 6B, the triggering of the electric switch 1000 begins. By separating the switch contacts 1211, 1221; 1212, 1222; 1213, 1223 in the separation zone 1201; 1202; 1203, an electric arc (LB) is produced which heats up its surroundings, thus resulting in a high pressure. The excess pressure sets the actuating member 110 into motion (upward according to the illustration in FIG. 6B) and triggers the electric switch 1000. Up to the triggering time, the vent is closed (bore 149 is concealed by the actuating member 110), and therefore the pressure cannot substantially dissipate up to this time.

Figure 6C:
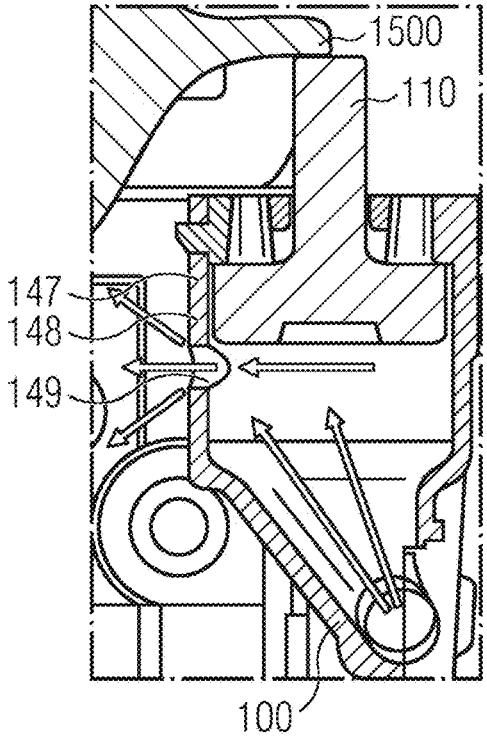

After the actuating member 110 has actuated the trigger lever 1500, the latter, even after being triggered, is pushed further upward by the excess pressure and thereby passes through the bore 149 for venting in accordance with the illustration in FIG. 6C. The vent can be a bore 149 or else can be in the form of a slot. During the venting, the hot gases flow out of the bore 149 and the pressure in the pressure trigger 100 dissipates.

Figure 6D:
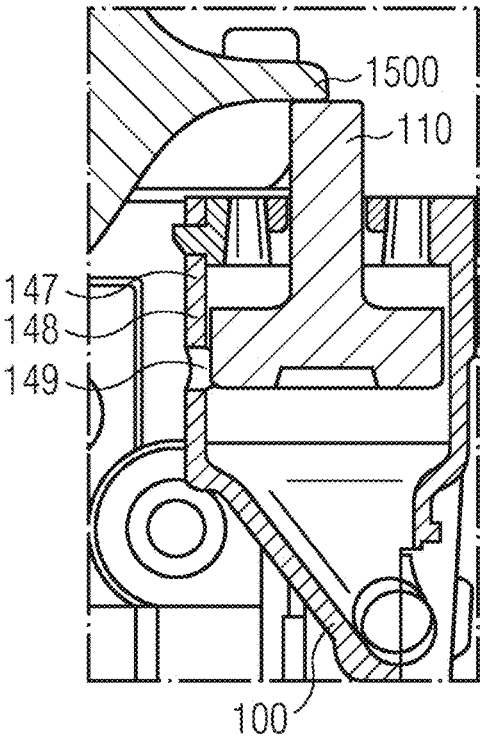

After the pressure in the pressure trigger 100 has dissipated, the actuating member 110 can be pressed downward by a torsion spring in the breaker mechanism lever and can thereby be brought into the starting position, as is shown in FIG. 6D.

Figure 7B:
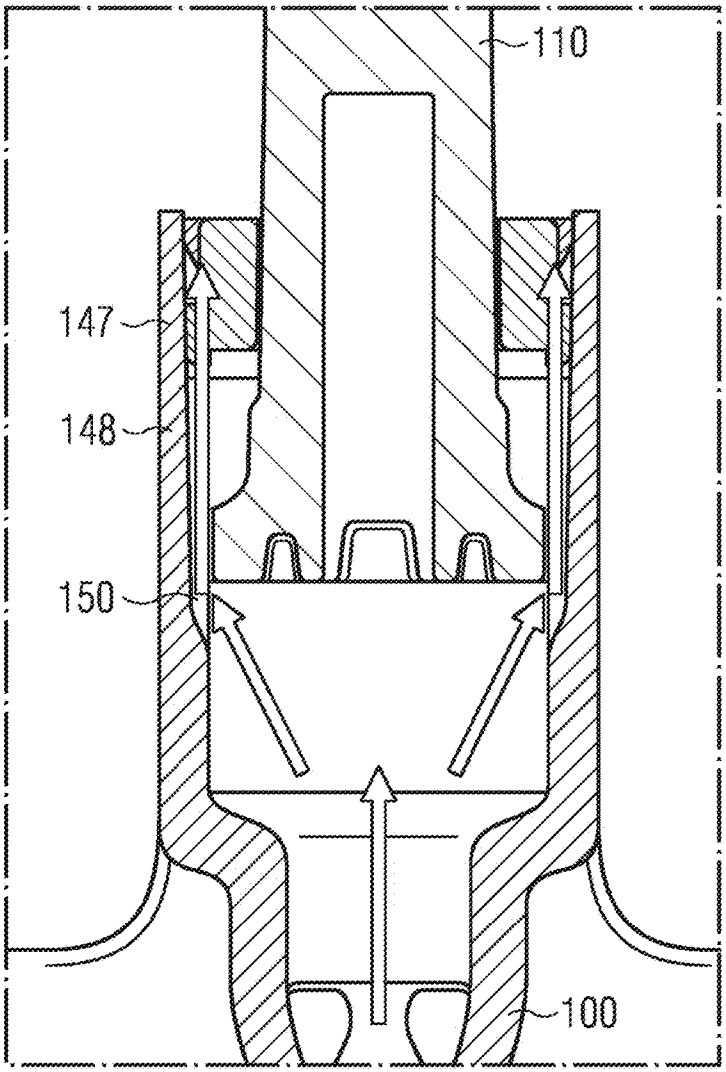
FIGS. 7A and 7B show a trigger element with an alternative relief of pressure.
Figure 7A:
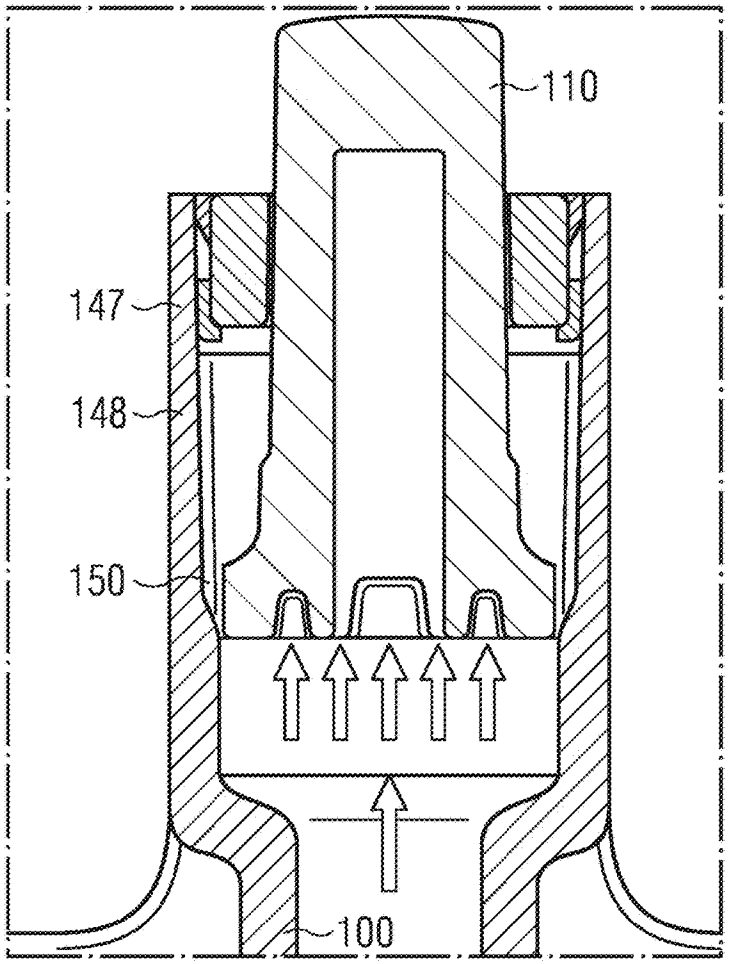

An alternative relief of pressure is illustrated in FIGS. 7A and 7B. By way of a recess 150 in the form of an expansion in the guide of the housing 148, a relief of pressure can also arise in a predefined position by the hot gases then being able to flow past the actuating member 110.

In contrast to the illustration of FIG. 6C, in the alternative relief of pressure of FIGS. 7A and 7B the hot gases flow in the direction of movement of the actuating member 110 and not perpendicularly to its direction of movement.

The recess 150 can be provided only in sections on the guide of the housing 148, thus only at certain points on the circumference. This ensures that the actuating member 110 continues to be guided despite the recess 150 and does not tilt or become blocked.

The invention claimed is:

1. A trigger element comprising:

an actuating member of a pressure trigger for an electric switch, the pressure trigger being provided with at least one flow channel for each of at least one electric pole of the electric switch, the at least one electric pole of the electric switch including at least two switch contacts for making or breaking a current path, wherein the at least two switch contacts of the at least one electric pole of the electric switch being disconnectable via the actuating member, the actuating member being configured to respond to an increase in pressure generated by an electric arc drawn during electrodynamic recoil of the at least two switch contacts in a separation zone of the at least two switch contacts, wherein, through the increase in pressure generated by the electric arc, the pressure trigger is set into motion, wherein the separation zone is connectable to the actuating member via the at least one flow channel, and the actuating member being guidable by a housing of the trigger element between a neutral position and a trigger position, wherein, after the trigger position has been reached, the pressure trigger is configured such that a relief of pressure vents the pressure trigger, wherein the actuating member is movable in a guide of the housing and wherein a recess in the guide of the housing is configured to bring about the relief of pressure of the pressure trigger in the trigger position.

2. The trigger element of claim 1, wherein, in the trigger position, the at least two switch contacts of the at least one electric pole of the electric switch are separated.

3. The trigger element of claim 2, wherein the actuating member is movable in the guide of the housing between the neutral position and the trigger position.

4. The trigger element of claim 2, wherein a bore, a slot or another opening in the housing is configured to bring about the relief of pressure of the pressure trigger in the trigger position.

5. The pressure trigger comprising the trigger element of claim 2. electric switch are separated.

6. The trigger element of claim 1, wherein the actuating member is movable in a guide of the housing between the neutral position and the trigger position.

7. The trigger element of claim 6, wherein a recess in the guide of the housing is configured to bring about the relief of pressure of the pressure trigger in the trigger position.

8. The trigger element of claim 6, wherein a bore, a slot or another opening in the housing is configured to bring about the relief of pressure of the pressure trigger in the trigger position.

9. The trigger element of claim 1, wherein a bore, a slot or another opening in the housing is configured to bring about the relief of pressure of the pressure trigger in the trigger position.

10. A pressure trigger comprising:

a trigger element, the trigger element including an actuating member of the pressure trigger for an electric switch, the pressure trigger being provided with at least one flow channel for each of at least one electric pole of the electric switch, the at least one electric pole of the electric switch including at least two switch contacts for making or breaking a current path, wherein the at least two switch contacts of the at least one electric pole of the electric switch being disconnectable via the actuating member, the actuating member being configured to respond to an increase in pressure generated by an electric arc drawn during electrodynamic recoil of the at least two switch contacts in a separation zone of the at least two switch contacts, wherein, through the increase in pressure generated by the electric arc, the pressure trigger is set into motion, wherein the separation zone is connectable to the actuating member via the at least one flow channel, and the actuating member being guidable by a housing of the trigger element between a neutral position and a trigger position, wherein, after the trigger position has been reached, the pressure trigger is configured such that a relief of pressure vents the pressure trigger, wherein the actuating member is movable in a guide of the housing and wherein a recess in the guide of the housing is configured to bring about the relief of pressure of the pressure trigger in the trigger position.

11. The pressure trigger of claim 10, wherein the pressure trigger further comprises a non-return valve, configured to permit a flow only from the separation zone in a direction of the actuating member.

12. The pressure trigger of claim 11, wherein the pressure trigger is constructed modularly from at least two valve elements having a respective non-return valve and a respective flow channel and the trigger element of the actuating member, and wherein the at least two valve elements and the trigger element are designed to be plugable together.

13. The pressure trigger of claim 12, wherein the pressure trigger further comprises closing elements and connecting elements, to connect the at least two valve elements or the trigger element to one another or to close the at least two valve elements or the trigger element.

14. The pressure trigger of claim 10, wherein the pressure trigger is constructed modularly from at least two valve elements having a respective non-return valve and a respective flow channel and the trigger element of the actuating member, and wherein the at least two valve elements and the trigger element are designed to be plugable together.

15. The pressure trigger of claim 14, wherein the pressure trigger further comprises closing elements and connecting elements, to connect the at least two valve elements or the trigger element to one another or to close the at least two valve elements or the trigger element.

16. An electric switch comprising:

a plurality of poles; and the pressure trigger of claim 10, wherein the plurality of poles of the electric switch each include at least two switch contacts for making or breaking the current path, wherein the at least two switch contacts of each of the plurality of poles of the electric switch are disconnectable via the actuating member, the actuating member being configured to respond to the pressure generatable by the electric arc drawn during electrodynamic recoil of the at least two switch contacts in the separation zone of the at least two switch contacts, and wherein respective separation zones of the at least two switch contacts of each of the plurality of poles of the electric switch are connected to the actuating member via respective ones of a plurality of flow channels.

17. The electric switch of claim 16, wherein the electric switch comprises two or three electric poles, and wherein the pressure trigger comprises three or four flow channels.

* * * * *